US006356035B1

(12) United States Patent
Weng

(10) Patent No.: US 6,356,035 B1
(45) Date of Patent: Mar. 12, 2002

(54) DEEP PWM DIMMABLE VOLTAGE-FED RESONANT PUSH-PULL INVERTER CIRCUIT FOR LCD BACKLIGHTING WITH A COUPLED INDUCTOR

(75) Inventor: Da Feng Weng, Yorktown Heights, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/723,126

(22) Filed: Nov. 27, 2000

(51) Int. Cl.[7] ..... H05B 37/02
(52) U.S. Cl. ..... 315/209 R; 315/219; 315/224
(58) Field of Search ..... 315/224, DIG. 5, 315/219, 276, 277

(56) References Cited

U.S. PATENT DOCUMENTS 6,172,464 B1 * 1/2001 Nilssen ..... 315/56

* cited by examiner

*Primary Examiner*—David Vu

(57) ABSTRACT

An LCD backlighting inverter circuit comprising a voltage-fed series resonant push-pull inverter that is capable of efficient operation in a PWM deep dimming mode. The voltage-fed series resonant push-pull inverter comprising: a DC voltage source, a transformer having a first and a second primary winding and at least one secondary winding adapted to be connected in series with a lamp load; a first resonant circuit including a first resonant inductor and a resonant capacitor, a second resonant circuit including a second resonant inductor and the resonant capacitor, the second resonant inductor being magnetically coupled to the first resonant inductor. The inverter circuit is rapidly switched on and off to perform deep pulse with modulated (PWM) dimming. The voltage fed push-pull inverter has a low input impedance and a high output impedance for driving CCFL loads and the like in a PWM deep dimming mode. The inverter circuit is further characterized as having an initial high Q value sufficient to breakdown a lamp load (i.e., reducing the high startup resistance), and subsequent to breaking down a lamp load the Q of the circuit automatically transitions to a low Q value without the need for monitoring and/or switching circuitry. For those situations where the load is a CCFL load or the like, the driving source is current driven to stabilize the load.

10 Claims, 5 Drawing Sheets

DEEP PWM DIMMABLE VOLTAGE-FED RESONANT PUSH-PULL INVERTER CIRCUIT FOR LCD BACKLIGHTING WITH A COUPLED INDUCTOR

BACKGROUND OF THE INVENTION

1. Field of the Invention

The present invention relates to an improved apparatus and method for operating dimming fluorescent lamps in a deep dimming mode, and, in particular, to a push-pull inverter circuit capable of operation in a pulse width modulated (PWM) deep dimming mode.

2. Description of the Related Art

Existing LCD back lighting systems utilize a variety of circuit topologies. Two popular circuit topologies are the half bridge inverter and buck power stage plus current-fed push-pull inverter (also referred to as a Royer inverter).

To conserve energy most LCD back lighting systems including those described above are dimmable systems. For those applications which use CCFL lamps, two dinmming methods are commonly employed. A first method is PWM power regulation, and a second method is output current regulation using frequency shift or input voltage regulation. FIG. 1 illustrates a buck power stage 2 plus current feed push-pull inverter 4 topology. This circuit topology performs the dimming function by PWM output current regulation. The buck power stage is used to regulate the output current. The output current in turn regulates the output power to perform PWM dimming. The current-fed push-pull portion does not include a power regulation function. To perform dimming, the buck power stage controls the output power which controls the amplitude of the lamp current. The efficiency of the overall circuit topology of the prior art circuit of FIG. 1 is determined by the efficiencies of the constituent stages, namely, the buck power stage and the current-fed push-pull stage. While the current-fed push-pull stage can reach a high efficiency, the buck power is inherently inefficient. A further shortcoming of the circuit is that it is not suitable for operation in a pulse width modulated deep dimming mode. To make the circuit suitable for deep dimming applications, it is necessary to convert the current fed push-pull configuration to a voltage fed push pull configuration. A voltage fed push-pull configuration is more desirable than a current fed push-pull configuration. This is required because a voltage fed push-pull configuration can respond much faster to input current changes.

FIG. 2 illustrates half-bridge type inverter circuit topology of the prior art. The half-bridge type inverter topology is a more efficient circuit topology than the buck stage/push-pull type inverter topology described above. Similar to the push-pull type inverter, the half-bridge type inverter includes a transformer T. It is well known in the art that for a half-bridge inverter circuit configuration the output voltage $V_{out}$ is generally half of the input voltage, $V_{in}$. So for a 12V input voltage the maximum voltage on the primary of the transformer is 6V. However, the lamp requires a voltage on the order of 690V. As such, the turns ratio of the transformer must be greater than 100×. The high turns ratio of the transformer T reduces the efficiency of the circuit. A further shortcoming of this circuit configuration is that although the steady-state current of the load $R_L$ (i.e., lamp) is 6 milliamps, the reflected current is very high due to the transformer turns ratio. The high reflected current further serves to reduce the efficiency of the circuit.

SUMMARY OF THE INVENTION

It is an object of the present invention to provide a voltage-fed series resonant push-pull inverter that is capable of efficient operation in a PWM deep dimming mode.

According to one aspect of the present invention, there is provided a voltage-fed series resonant push-pull inverter comprising: a DC voltage source, a transformer having a first and a second primary winding and at least one secondary winding adapted to be connected in series with a lamp load; a first resonant circuit including a first resonant inductor and a resonant capacitor, one side of said first resonant inductor connected in series with said first primary winding of said transformer, the other side of said first resonant inductor being connected in series a first switching transistor and also connected to one side of said resonant capacitor;

The novel circuit further comprises: a second resonant circuit including a second resonant inductor and the resonant capacitor, one side of said second resonant inductor connected in series with said second primary winding of said transformer, the other side of said second resonant inductor being connected in series with a second switching transistor and also connected to the other side of said resonant capacitor, said resonant inductor being magnetically coupled to said first resonant inductor;

The construction of the novel circuit allows it to be rapidly switched on and off to perform deep pulse with modulated (PWM) dimming.

According to another aspect of the invention, the first and second resonant inductors are magnetically coupled to each other whereby each inductor stores energy in a respective half-switching cycle whereby the stored energy is released in the next half-switching cycle thereby providing a boost function.

According to a further aspect of the invention, the voltage fed push-pull inverter has a low input impedance and a high output impedance for driving CCFL loads and the like in a PWM deep dimming mode.

According to yet another aspect of the invention, the inventive circuit has a high Q value sufficient to breakdown a lamp load (i.e., reducing the high startup resistance), and subsequent to breaking down a lamp load the Q of the circuit transitions to a low Q value without the necessity of utilizing prior art techniques for recognizing when a lamp load transitions from the breakdown state.

One feature of the inverter of the present invention is that in situations where the load is a CCFL load or the like, the driving source is current driven to stabilize the load.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DETAILED DESCRIPTION OF THE PREFERRED EMBODIMENTS

Construction

Figure 1:
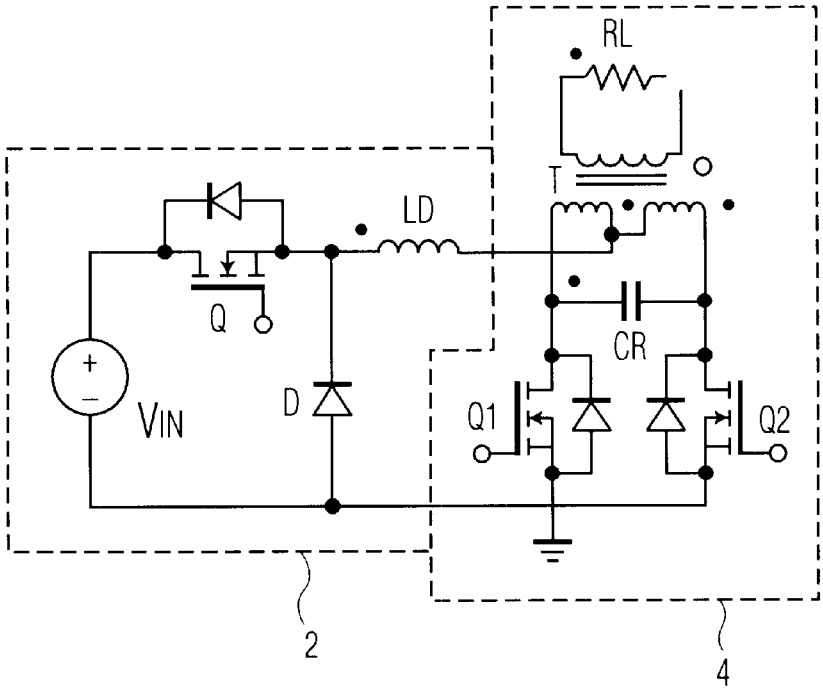
FIG. 1 PRIOR ART
FIG. 1 is a circuit diagram illustrating an LCD backlighting inverter circuit of the prior art.
Figure 2:
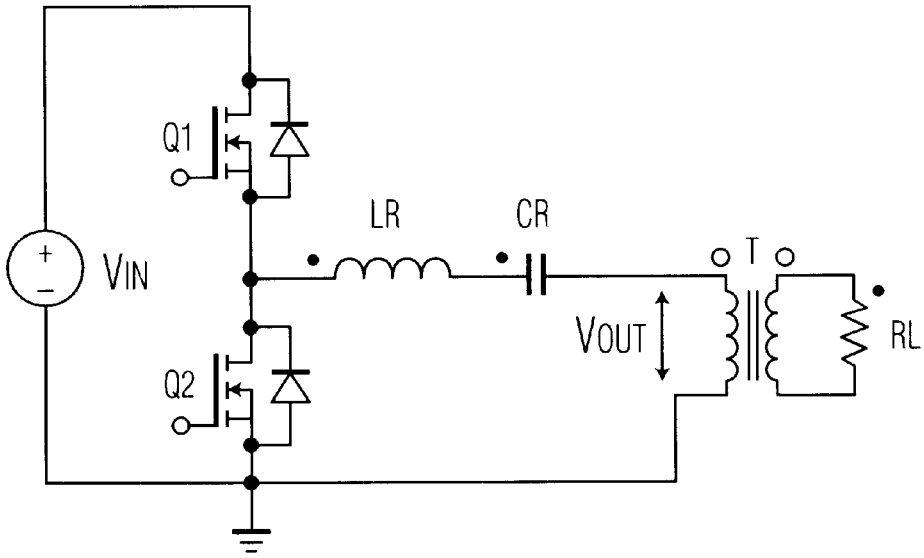
FIG. 2 PRIOR ART
FIG. 2 is a circuit diagram illustrating an LCD backlighting inverter circuit of the prior art.
Figure 3:
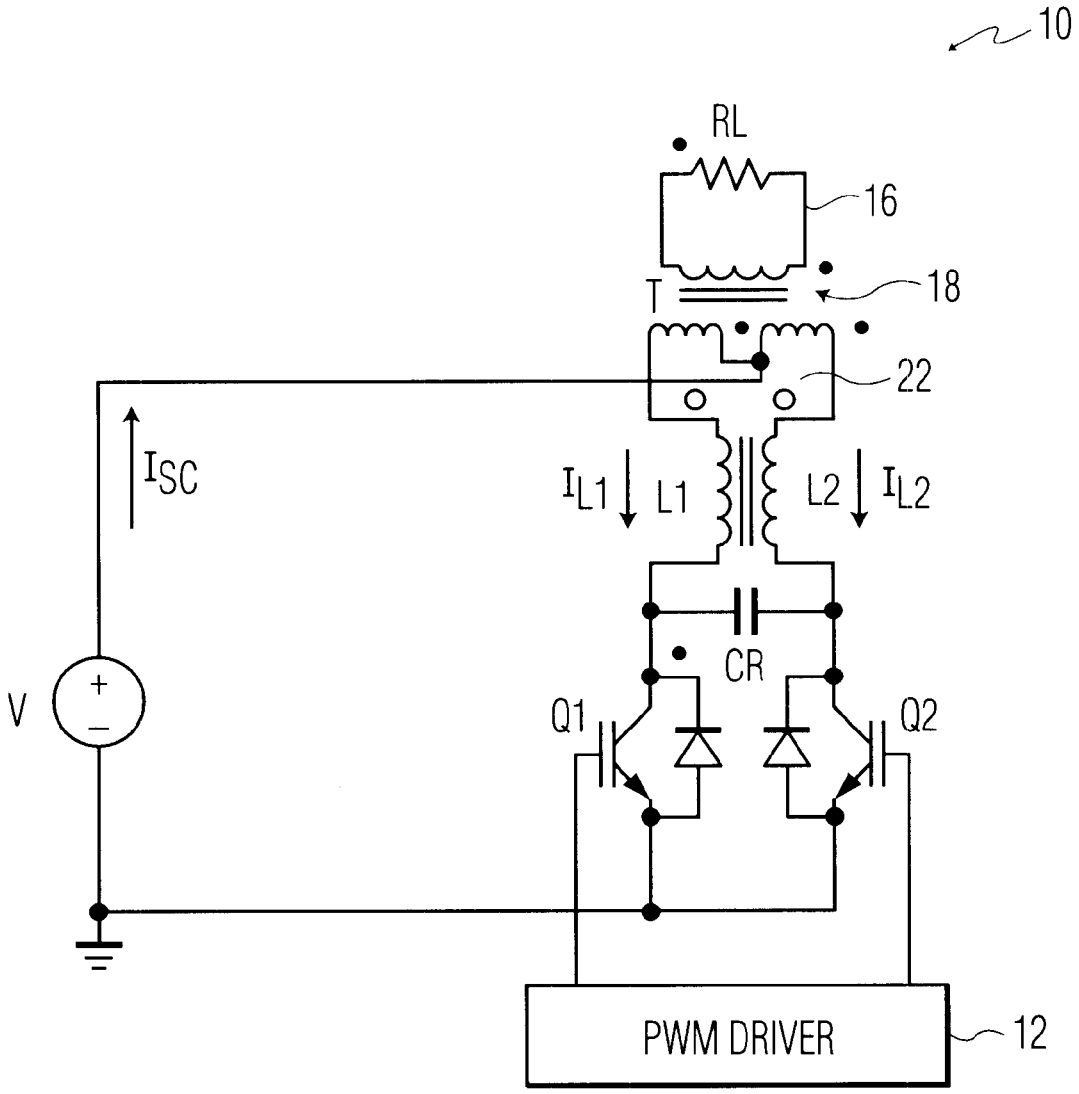
FIG. 3 is a circuit diagram illustrating an LCD backlighting inverter circuit in accordance with an embodiment of the present invention.

Turning now to the drawings, in which like reference numerals identify similar or identical elements throughout the several views, FIG. 3 illustrates a deep PWM dimmable voltage-fed resonant push-pull inverter 10 according to a preferred embodiment of the present invention. It is envisioned that the improved circuit according to the present invention will be used in deep pulse-width modulated (PWM) dimming applications.

As shown in FIG. 3, inverter 10, which includes a PWM driver circuit 12, is connected to a load $R_L$. Load $R_L$ can be, but is not limited to a fluorescent lamp of the cold cathode type. The light from $R_L$ can be used to illuminate a liquid crystal display (LCD) of a computer (not shown). Load $R_L$ is connected to a secondary winding 16 of a transformer T.

Transformer T has a primary winding 18 whose midpoint 22 is connected to a voltage source V. Each terminal of the transformer T is connected in series with a respective inductor of the coupled inductor pair L1/L2. The opposite terminals of coupled inductor pair L1/L2 are connected to terminals of switching transistors Q1 an Q2, respectively. Resonant capacitor $C_r$ extends across the terminals of coupled inductor pair L1/L2 above switching transistors Q1, Q2. Switching transistors Q1 and Q2 are driven by PWM driver circuit 12.

Details of Operation

Steady State Operation

The operation of the inverter circuit 10 is symmetrical in each half cycle of the successive ON/OFF switching cycles of switching transistors Q1 and Q2 which operate at a constant frequency (i.e., 30 kHz) and at constant duty cycle (i.e., 50%). As a consequence of the switching cycle symmetry, the circuit operation will be described for the half cycle defined as {Q1 ON/Q2 OFF} for ease of explanation. By symmetry, the {Q1 OFF/Q2 ON} half cycle is analogously described.

{(Q1 ON/Q2 OFF} Half Switching Cycle

The operation of the circuit of FIG. 3 will now be described for the Q1 ON/Q2 OFF half switching cycle with reference to the circuit waveforms of FIG. 4.

Figure 4:
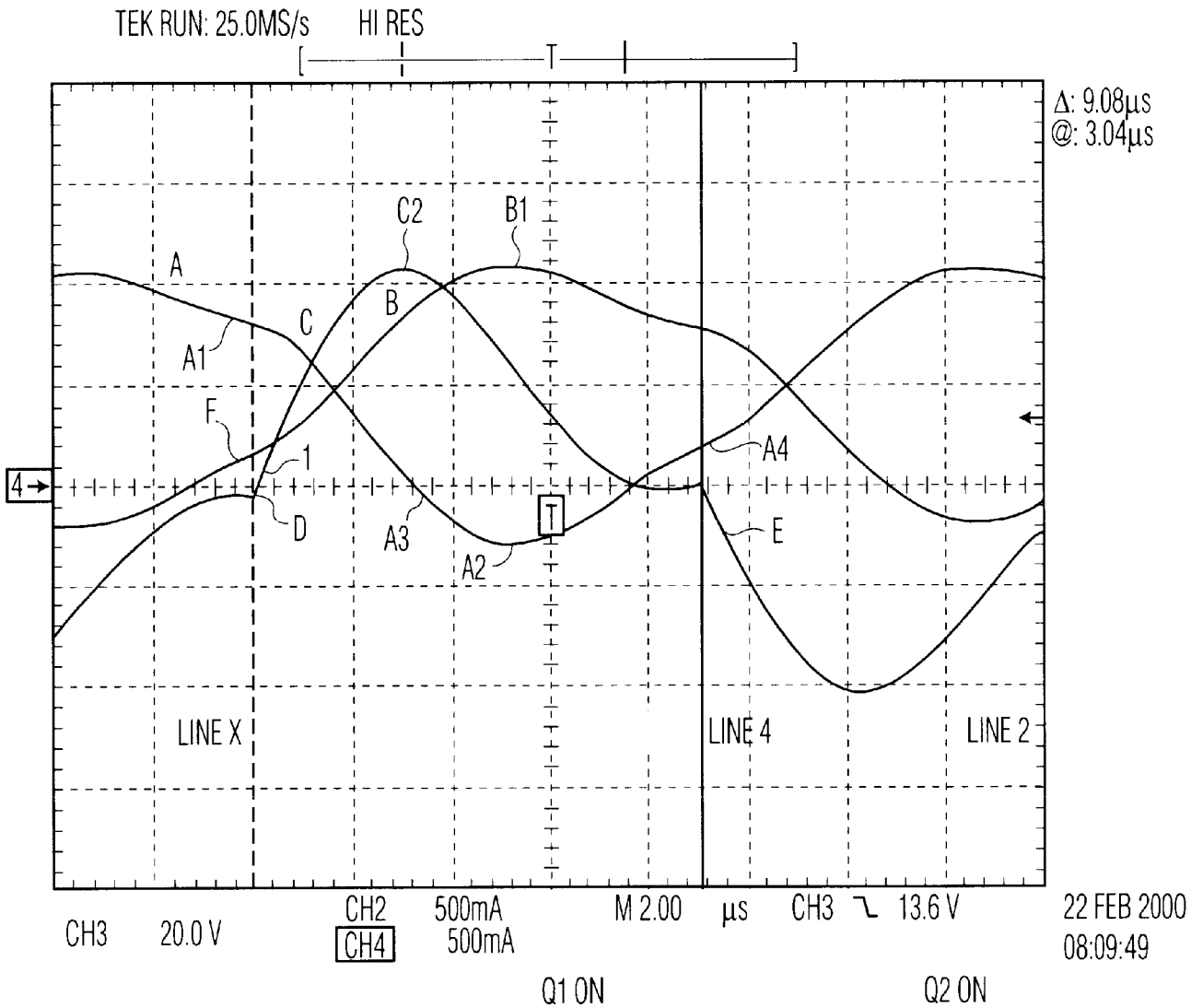
FIG. 4 illustrates representative current/voltage waveforms present in the circuit of FIG. 3.

FIG. 4 illustrates circuit voltage/current waveforms (e.g., waveforms A, B and C) for one full switching cycle of the inverter circuit 10. Demarcation lines X and Y define the beginning and end of the first half switching cycle {Q1 ON/Q2 OFF}, and demarcation lines Y and Z define the beginning and end of the second half switching cycle {Q1 OFF/Q2 ON}.

Referring now to the first half switching cycle {Q1 ON/Q2 OFF}, waveform (A) describes the current through inductor L2, $I_{L2}$, waveform (B) describes the inductor current through L1, $I_{L1}$, and waveform (C) describes the voltage across capacitor Cr, $V_{CR}$. Waveforms A, B and C are shown for one complete switching cycle. However, as a consequence of the circuit symmetry, the waveforms will be discussed only for the {Q1 ON/Q2 OFF} half switching cycle.

It is assumed that just prior to Q1 being turned ON (point D) at the start of the first half switching cycle, the voltage on the resonant capacitor Cr, waveform (C), is substantially zero volts (point F) and the currents in the coupling inductor L1/L2, $I_{L1}$ and $I_{L2}$, are both positive currents (i.e., the currents travel in a direction away from the source, $V_{in}$, see FIG. 3).

It is further assumed that the impedance of a magnetizing inductance (not shown) associated with transformer T is much higher than the reflected load impedance of load $R_L$ (not shown).

At a point at which Q1 is turned ON (see point D) for the half switching cycle defined by {Q1 ON/Q2 OFF }, a positive DC current $I_{DC}$ is formed by a current loop defined by DC voltage, Vin, the reflected load resistance $R_{REFL}$ (not shown), inductor L1 and switching transistor Q1. It is noted that switching transistors Q1 and Q2 are switched at a point at which the voltage across $C_r$ is substantially zero to effect zero voltage switching (see points D and E).

From the point at which Q1 is turned on (see point D) at the start of the half-cycle, the current in L1, $I_{L1}$, increases until point B1, as described by waveform (B).

Also, at the point at which Q1 is turned on at point D, energy previously stored in inductor L2 in the previous half-switching cycle resonantly decreases, as described by waveform (A), representing $I_{L2}$, (between points A1 to A2). The energy is released to capacitor Cr. Waveform (C), from substantially points C1–C2, describes the transfer of energy as an increased voltage across capacitor $C_r$ as stored energy from inductor L2 is transferred to capacitor $C_r$. It is noted that during this period of energy release from inductor L1, capacitor $C_r$ is being charged from two sources, the input voltage source, $V_{in}$, and from the stored energy released from inductor L2. This latter source is referred to as a boost function. That is, it provides an additional charge on capacitor $C_r$ above and beyond what is normally provided by the voltage source, $V_{in}$. For the present half-cycle, the boost function is considered to be operative from substantially the Q1 turn on point (point D) until the point at which $C_r$ reaches its maximum value (see point C2). At the point at which $C_r$ reaches it maximum value (point C2), $C_r$ is then considered to be in resonance with inductor L2. Capacitor $C_r$ is said to be in resonance with inductor L2 at point C2 because the energy which was initially transferred from inductor L2 to $C_r$ is then resonantly returned through both inductor L2 and the load's reflected resistor $R_{REFL}$ back towards the source, $V_{in}$. This return of resonant energy is shown as inductor current, $I_{L2}$, (See waveform (A) from point A3 to point A4) which is in series with the input DC voltage Vin through the reflected resistor $R_{REFL}$. The inductor current, $I_{L2}$, from points A3 to A4 may be characterized as a negative half-period current in that the $I_{L2}$ current is in a direction opposite that of the source current $I_{DC}$.

During this half-switching cycle, inductor L1 is charged from the voltage source, Vin, through the reflected resistor $R_{REFL}$ and switching transistor Q1 to store energy which provides a boost function in the next half cycle, similar to that described above with regard to inductor L2 in the current half-switching cycle. It is noted that the process of storing energy to be released in the next-half cycle is alternately repeated for each of the resonant inductors.

The resonant energy stored in inductor L2, in addition to providing a boost function, will partially couple to inductor L1 as current $I_{L2}$ having both AC and DC components. The AC component of the coupled current $I_{L2}$, is out-of-phase with the AC component of current $I_{L1}$ The out-of-phase AC current coupled from inductor L2 has the effect of reducing the undesirable AC component (i.e., AC ripple) of current $I_{Dc}$ thereby maintaining the DC level of current $I_{DC}$ at a relatively constant level. The magnitude of the AC current coupled from inductor L2 is a function of the coupling co-efficiency between inductors L1 and L2. Therefore, the coupling coefficient is established at a predetermined value sufficient to make the high frequency ripple of the output current of the DC voltage source very low. The current in L2, $I_{back}$, increases from zero to a negative maximum value. The current in L2 and the voltage on Cr decreases until zero.

As the voltage on Cr reaches zero (point E), Q1 turns OFF and Q2 turns ON. It is noted that throughout the first half cycle discussed above, Inductor L1 stores energy from the input DC voltage source Vin, which will be used in the next half cycle to create a resonance with L2. Further, the second half switching cycle, defined by {Q1 OFF/Q2 ON} is similar to the first half switching half cycle described above with the waveforms for L1 and L2 reversed, and the waveform for Cr being negative that for the Q1 ON/Q2 OFF portion.

Thus, during the second half switching cycle, L2 is charged from input DC voltage source, Vin, and stores energy which will be used to create a resonant condition in the next half switching cycle. During this half-cycle, inductor L1 resonates with Cr to generate the out-of-phase AC component that is transferred to L2 due to the coupling of inductors L1/L2.

This coupling for each half-cycle causes the high frequency ripple of the output current of the input DC voltage source to be very low. The couple coeficiency of the couple inductors will affect how much magnetic energy will couple from L1 to L2 or L2 to L1. There is an optimum value for the minimum high frequency ripple. The transformer T outputs two half cycles of AC current to the lamp created in the primary winding due to the out-of-phase switching of Q1 and Q2. Because the reflected resistor R is in series with L2 and Cr or L1 and Cr, the current in the lamp will be controlled by the L2 and Cr or L1 and Cr series resonant circuit. As such, the inverter is a high frequency current source to drive the lamp, without the need for a ballast capacitor in the output of the transformer as is required in voltage driven sources of the prior art. The transformer only transfer real power from primary to secondary. There is no reactive power passing through the transformer. The inverter can have higher efficiency.

Lamp Start Operation.

Lamp start operation operates in a different manner than the normal operation discussed above. Before the resistance of the lamp is reduced by the startup voltage, the lamp has a high impedance.

Figure 5A:
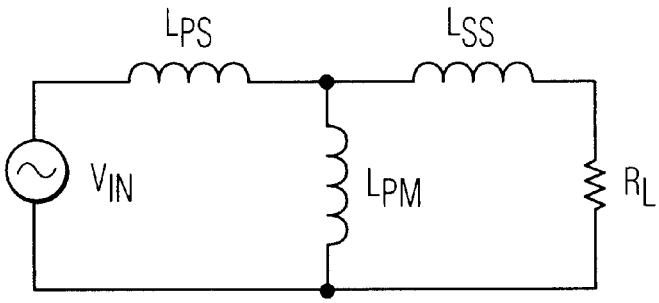
FIGS. 5*a–d* illustrate various circuit configurations for describing a lamp start operation.

FIG. 5*a* illustrates a T-type transformer model whereby the transformer T of the inventive circuit of FIG. 3 is represented by three inductors: a primary leakage inductor, $L_{ps}$, a secondary leakage inductor $L_{ss}$, and a magnetizing inductor, $L_{pm}$. The T-type model is a standard model, well known in the art. Vin represents a general input voltage for describing the T-type model.

Figure 5B:
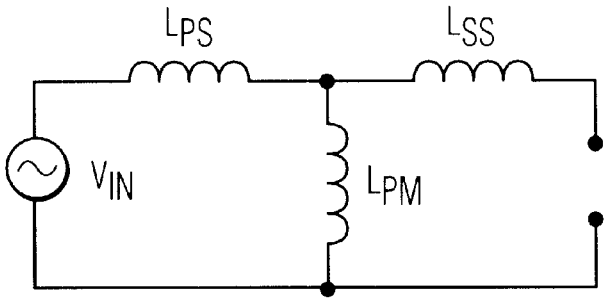

FIG. 5*b* illustrates the transformer circuit of FIG. 5*a* for lamp start operation. That is, the resistance of the lamp is sufficiently high such that it can be characterized as an open circuit. In this case, all of the current travels through the magnetizing inductor, $L_{pm}$.

Figure 5C:
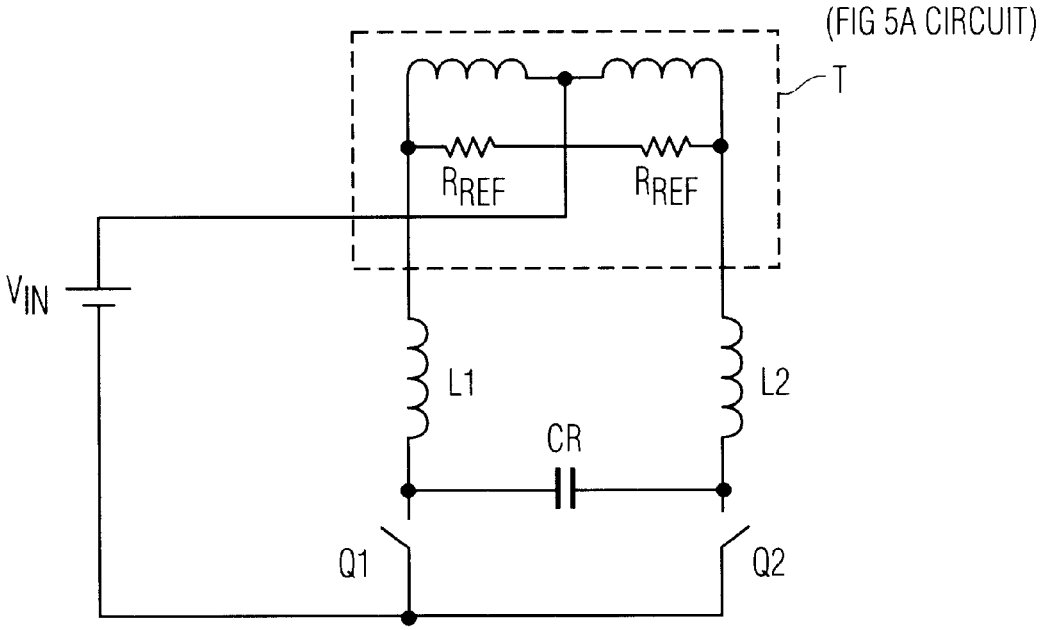

FIG. 5*c* represents the inventive circuit of FIG. 3 for a normal operating condition, that is where the circuit of FIG. 5*a* would represent the transformer T, shown in FIG. 3, and the reflected load, $R_{refl}$. As shown in FIG. 5*c*, the reflected load resistance, $R_{refl}$, represents the lamp load in the secondary of transformer T reflected back into the primary labeled as $R_{feffl}$.

Figure 5D:
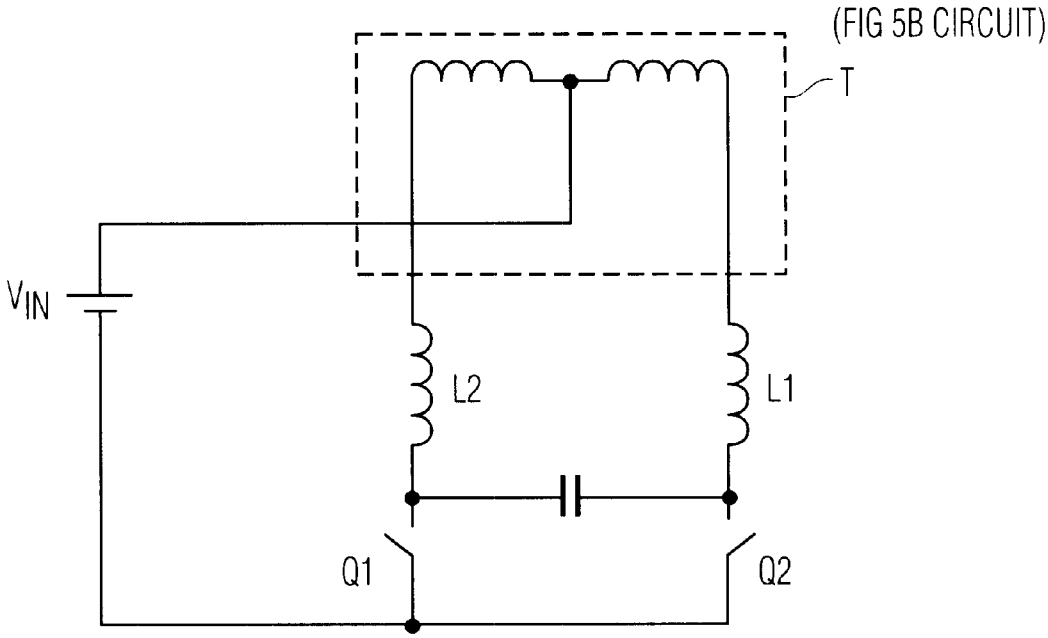

FIG. 5*d* illustrates the inventive circuit of FIG. 3 for the lamp start condition, that is, where the circuit of FIG. 5*b* would represent the transformer T and load shown in FIG. 3. In this case, as discussed above, and shown at FIG. 5*b*, the load resistance, $R_L$, is so high as to be effectively considered an open circuit. Accordingly, the value of this resistance, $R_L$, reflected into the primary is also effectively considered an open circuit, and is therefore removed from the circuit illustration of FIG. 5*d*.

In general, the output or secondary voltage of the inventive circuit of FIG. 3 for driving the load, $R_L$, may be written as:

$$V_{out}=N*(L_{PM}/(L_R+L_{PM})*Q*V_{in}$$

Where:

N is the transformer turns ratio associated with the transformer T of the inventive circuit;

$L_{ps}$ is the primary leakage inductor of the T-type circuit model of transformer T;

$L_{ss}$ is the secondary leakage inductor of the T-type circuit model of transformer T;

$L_{pm}$ is the magnetizing inductor of the T-type circuit model of transformer T;

$L_R$ is either L1 or $L_2$ depending on the half-cycle;

$V_{in}$ is the input or source voltage for driving the inventive circuit of FIG. 3;

Q is the efficiency factor associated with the inventive circuit of FIG. 3, which may be written as $$Q=w*L_f/R_f$$

where $R_f$ represents the real part of the equivalent series resistance of the circuit of FIG. 3, $R_f$, which may be written as:

$$R_f = \frac{R*W^2*L^2}{R^2+W^2*L^2}$$

At lamp startup, as discussed above, and shown in FIG. 5*d*, the circuit resistance $R_{circuit}$ is very small because the lamp or load presents a very high initial resistance prior to the lamp or load being broken down. The reflected resistance of the lamp or load is described in the equations above as R.

At lamp startup the Q of the circuit is very high as a consequence of the load having a very high value, and the series resistance of the circuit $R_f$ therefore having a very low value, which is the denominator of the Q equation above. The large value of Q at start up multiplied by the turns ratio, N, and the other terms described above results in a very high startup value for $V_{out}$. This high initial startup value of $V_{out}$ is sufficient to breakdown the lamp load, causing its in resistance, $R_L$, to go from effectively an infinite value to a value on the order of 115 k. This value reflected back into the primary results in a breakdown reflected voltage value on the order of 30 ohms. It is therefore shown that subsequent to lamp breakdown the Q of the circuit naturally transitions from a very high Q value to a very low Q value without the need for external monitoring and/or switching means such as, for example, frequency switching and/or feedback loops as required in prior art configurations.

It will be understood that various modifications may be made to the embodiments disclosed herein, and that the above descriptions should not be construed as limiting, but merely as exemplifications of preferred embodiments. Those skilled in the art will envision other modifications within the scope and spirit of the claims appended hereto.

What is claimed is:

1. An LCD backlighting inverter circuit for performing deep pulse width modulated (PWM) dimming, said improved electronic LCD backlighting inverter circuit comprising:

a transformer having a first and a second primary winding and at least one secondary winding adapted to be connected in series with a lamp load;

a first resonant circuit including a first resonant inductor and a resonant capacitor, one side of said first resonant inductor connected in series with said first primary winding of said transformer, the other side of said first resonant inductor being connected in series with a first switching transistor and also connected to one side of said resonant capacitor;

a second resonant circuit including a second resonant inductor and the resonant capacitor, one side of said second resonant inductor connected in series with said second primary winding of said transformer, the other side of said second resonant inductor being connected in series with a second switching transistor and also connected to the other side of said resonant capacitor, said second resonant inductor being magnetically coupled to said first resonant inductor;

wherein said improved electronic LCD backlighting inverter circuit may be rapidly switched on and off to perform deep pulse width modulated (PWM) dimming.

2. The LCD backlighting inverter circuit of claim 1, wherein said circuit is a voltage-fed push-pull LLC resonant circuit.

3. The LCD backlighting inverter circuit of claim 1, further including switching means for alternately turning on said first transistor and said second switching transistor at a predetermined switching rate, said first resonant inductor storing energy while said second switching transistor is in an ON state and said first switching transistor is in an OFF state, said second resonant inductor storing energy while said second switching transistor is in an OFF state and said first switching transistor is in an ON state.

4. The backlighting circuit of claim 3, wherein the energy stored in at least one of the first and second resonant inductors provides a supplemental charging source to said resonant capacitor in a half-switching cycle subsequent to an energy storing half-switching cycle applied to the at least one of the first and second resonant inductors, the supplemental charge being in addition to a primary charging source provided by said input voltage to the resonant capacitor.

5. The backlighting circuit of claim 3, wherein a portion of the first resonant inductor's and said resonant capacitor's reflected energy is coupled to the second resonant inductor when second switching transistor is off and first switching transistor is on, the coupled energy substantially reducing a ripple current.

6. The backlighting circuit of claim 3, wherein a portion of the second resonant inductor's and said resonant capacitor's reflected energy is coupled to the first resonant inductor when second switching transistor is off and first switching transistor is on, the coupled energy substantially reducing a ripple current.

7. The LCD backlighting inverter circuit of claim 1, wherein the load is one of a cold cathode fluorescent lamp and a hot cathode fluorescent lamp.

8. The LCD backlighting inverter circuit of claim 1, wherein the load is a cold cathode fluorescent lamp that provides lighting for a flat panel display.

9. The LCD backlighting inverter of claim 1, wherein the secondary winding of the transformer is directly connected to the lamp load.

10. The LCD backlighting inverter of claim 1, wherein the Q of the circuit has a first value sufficient to breakdown the load to perform a lamp startup, and wherein the Q of the circuit has a second lower value than said first value subsequent to said load breakdown.

* * * * *